United States Patent [19]

Gagnon

[11] Patent Number: 4,903,742

[45] Date of Patent: Feb. 27, 1990

[54] LIQUID DISPENSING APPARATUS BOTTLE VALVE

[76] Inventor: Paul L. Gagnon, P.O. Box 267, Port Hueneme, Calif. 93041

[21] Appl. No.: 255,397

[22] Filed: Oct. 11, 1988

[51] Int. Cl.[4] ..... B67C 3/00

[52] U.S. Cl. ..... 141/353; 141/293; 141/302; 222/525; 222/501; 222/484

[58] Field of Search ..... 222/501, 485, 522, 525, 222/484; 141/360, 372, 375, 301, 302, 308, 309, 351, 357, 293, 294, 353, 354; 251/339

[56] References Cited

U.S. PATENT DOCUMENTS

| | | | |
|---|---|---|---|
| 1,250,941 | 12/1917 | Baer | 141/375 |
| 2,461,620 | 2/1949 | Wright | 222/525 |
| 2,714,475 | 8/1955 | Roehrich | 222/501 |
| 3,033,247 | 5/1962 | Beall | 141/308 |
| 3,207,190 | 9/1965 | Silbereis et al. | 141/308 |
| 4,624,395 | 11/1986 | Baron et al. | 222/501 |

FOREIGN PATENT DOCUMENTS

| | | | |
|---|---|---|---|
| 402172 | 4/1968 | Australia | 141/360 |
| 2607437 | 8/1976 | Fed. Rep. of Germany | 222/482 |

*Primary Examiner*—H. Grant Skaggs
*Attorney, Agent, or Firm*—Kenneth J. Hovet

[57] ABSTRACT

A valve assembly is attached to the spout of a water bottle which is used in liquid dispensing devices common in households and offices. The assembly combines a sleeve-like housing and a valve for preventing water spillage particularly when the bottle is being hoisted and inverted onto the dispensing device. An elongated actuator stem unseats a valve head section from sealing engagement with the housing as the bottle is lowered into the device. The valve assembly is releasably attached to the bottle spout and can be reused repetitively.

20 Claims, 2 Drawing Sheets

LIQUID DISPENSING APPARATUS BOTTLE VALVE

BACKGROUND OF THE INVENTION

1. Field of the Invention

The invention relates to the handling of heavy bottles used with liquid dispensing apparatus. More particularly, it concerns the use of a bottle valve assembly for preventing spillage during the inversion of a bottle upon a liquid dispensing apparatus.

2. Description of the Prior Art

The use of bottled water in households and businesses is widely prevalent. Typically, the water is delivered in large five to six gallon bottles having a spout with an outlet covered with a disposable protective cap. The cap is removed and the bottle is hoisted and inverted onto the dispensing apparatus. During hoisting and inverting, water will spill-out of the spout and create an untidy and unsafe condition.

Because of the above problem, various check valve devices have been developed to prevent spillage. For example, U.S. Pat. No. 4,508,246 describes a float valve that falls by gravity over a spout outlet during bottle inversion. It then floats away when the bottle is fully inverted. A significant disadvantage of this device is that a substantial amount of water will still spill-out. This occurs before sufficient inversion has taken place to move the float valve over the spout outlet.

Similar systems are shown in U.S. Pat. Nos. 939,594; 1,538,483 and 4,717,051. In these systems, plug or disc stoppers drop by gravity over bottle outlets to inhibit spillage during inversion. When the bottle is lowered into the dispensing apparatus, an elongated rod or stem dislodges the stopper by abutment with the inner container of the dispenser. Again, however, the above systems do not prevent water spillage during the time of initial inversion and before gravity moves the stopper into position.

SUMMARY OF THE INVENTION

Instead of relying on the delayed gravity drop action of the prior art, the present invention provides a valve assembly for affirmative closure of the bottle outlet before and during bottle inversion. This occurs by frictional engagement between a valve head section and a housing aperture.

The head section reciprocates within the aperture from a closed sealed position to an open position. The open position occurs when the bottle is lowered into the dispensing apparatus and an actuator stem contacts the container bottom and allows the aperture to move out of engagement with the head section. The housing includes attachment means for releasable securement to a bottle spout after removal of a protective cap.

DESCRIPTION OF THE PREFERRED EMBODIMENTS

Figure 1:
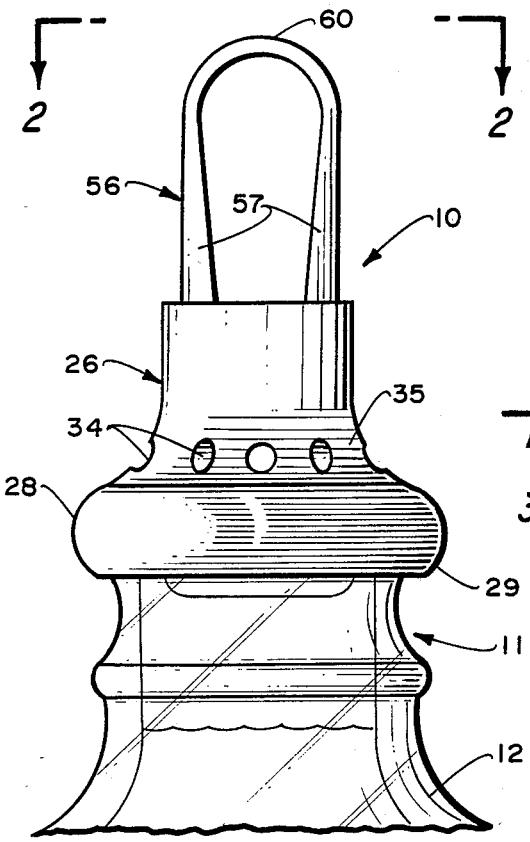
FIG. 1 is a side elevation view of the valve assembly of the invention in a closed position attached to the spout of a liquid container.
Figure 2:
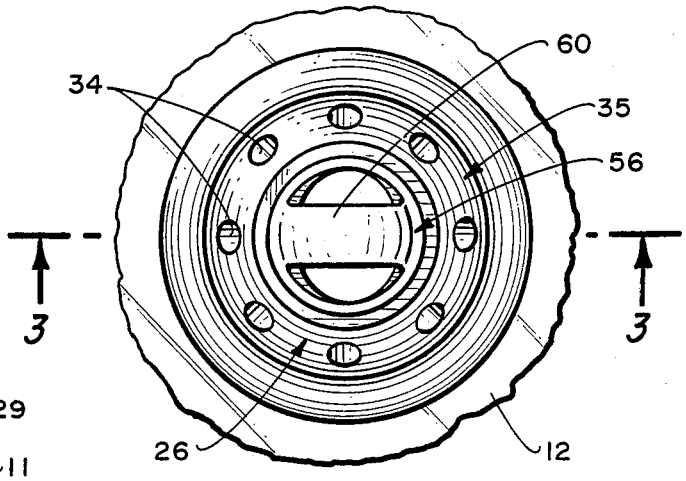
FIG. 2 is a top plan view taken along lines 2—2 of FIG. 1.

With reference to the drawings, FIG. 1 illustrates the overall valve assembly 10 attached to spout 11 of bottle 12. The bottle contains liquid 13 and the invention has particular application to the five and six gallon water bottles used with liquid dispensing apparatus 14.

Figure 5:
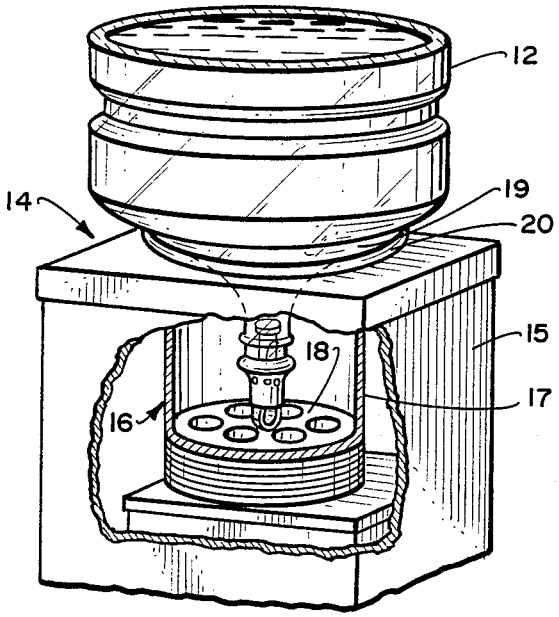
FIG. 5 is a reduced-scale fragmentary elevation view showing the valve assembly of FIG. 1 attached to a bottle inverted on a container within a liquid dispensing apparatus.

Such apparatus typically involves an outer free standing cabinet 15 and an inner liquid holding container 16. The inner container is bowl-shaped and includes sidewalls 17 extending from a bottom outlet wall 18. When the bottle is inverted and lowered onto the cabinet, bottle shoulder 19 will rest upon an upper cabinet ring 20 (FIG. 5).

Spout 11 is sufficiently elongated so that it will extend centrally from the shoulder into at least the upper half of the container in order to prevent overflow. Liquid will flow by gravity from the bottle into the container until the liquid level rises above the spout discharge outlet. This will then cut-off air to the bottle interior whereby further lowering of the bottle liquid level will create a vacuum thereabove. When the weight of the liquid in the bottle about equals atmospheric pressure, water will stop flowing from the bottle and overflow from the container will be avoided.

As is conventional, spout 11 is provided with a standardsized discharge outlet 22 defined by a large annular bead 23. Generally, a protective cap seal is used to cover the outlet during bottle storage and delivery. Prior to inversion of the bottle onto the dispensing apparatus, the cap seal is removed and replaced with the valve assembly of the present invention.

The valve assembly includes valve housing 26 having an attachment means for releasable securement to the spout. As shown, the attachment means comprises an outwardly flared skirt flange 28. The flange includes an inwardly curved peripheral end portion 29 that overlies and sealingly engages the annular bead 23. The curved end portion conforms to a major part of the bead curvature and has a diameter slightly less than the bead circumference. Preferably, it is constructed of a resilient material such as rubber or plastic. With the above characteristics, the skirt flange can stretch and firmly engage the bead in a releasable but sealable manner. Depending on the type of bottle design being used, other equivalent attachment means such as cooperating threads, friction ribs, clamps and tapered plug structures may be utilized.

The housing further includes a central aperture 30 which is in communication with outlet 22. The aperture is defined by a sleeve-shaped housing sidewall having an inner wall surface 31. An interior portion 32 of the aperture is enclosed by the housing and spout while an exterior portion 33 extends outwardly away from the spout. Desirably, the aperture extends lengthwise relative to the spout with its center axis coextensive with the longitudinal axis of the spout. It is also preferable that the interior portion 32 have a diameter less than outlet 22 so that it may conveniently overlie and extend concentrically into the spout a short distance. The interior portion terminates at top edge 36 which presents a flat ring-like surface.

Figure 4:
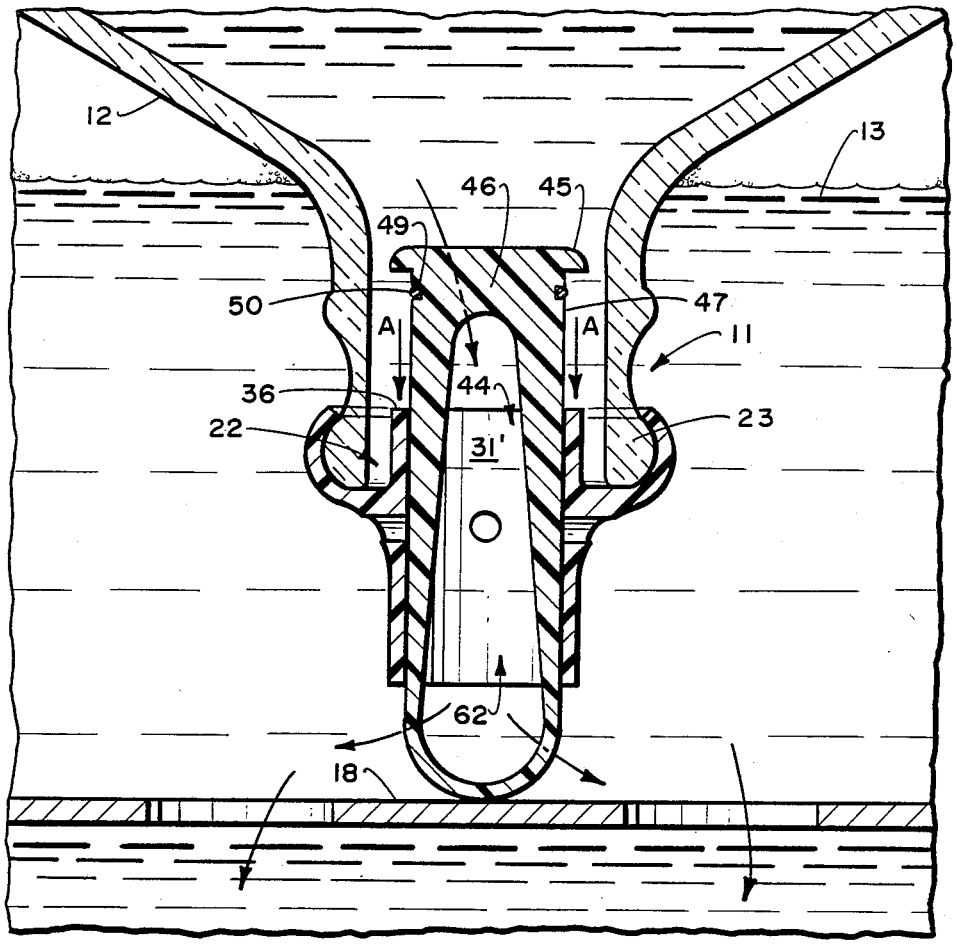
FIG. 4 is a cross-sectional view of the valve assembly of FIG. 1 in an open position on an inverted bottle within the inner container of a liquid dispensing apparatus.

To facilitate initial filling of the inner container, exterior portion 33 is provided with one or more vent openings 34 through its wall thickness. The openings are located in close proximity to outlet 22 at base region 35 of the exterior portion. This arrangement helps insure that the desired liquid depth will be attained somewhat above the level that outlet 22 projects into the container (FIG. 4).

Mounted for axial movement within the central aperture is a valve means shown as plunger 40. The plunger functions to control liquid flow from the bottle through the aperture. It entirely prevents such flow until the bottle spout is placed within the dispenser inner container. It then operates to open flow and permit filling of the container to a predetermined depth.

Figure 3:
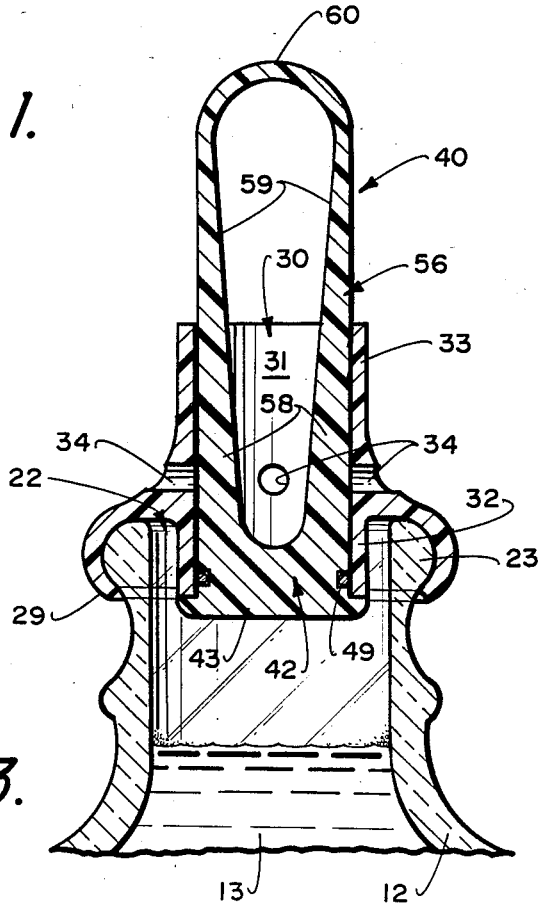
FIG. 3 is a cross-sectional view taken along lines 3—3 of FIG. 2.

With particular reference to FIG. 3, the plunger comprises a head section 42 from which extends an actuator stem 56. The head section includes an end plate 43 comprising a flat disc structure extending across interior aperture opening 44. It may include a peripheral flange 45 that overlies and abuts against top edge 36 in the valve closed position.

Extending outwardly from the underside of end plate 43 is ring part 46. The ring part comprises an annular-shaped wall structure having an outer surface 47 which conforms to the interior portion inner wall surface 31'. When in a valve closed position, as shown in FIG. 3, the ring part outer surface will form a sealing means and be in frictional engagement with the inner wall surface. To facilitate a firm but releasable sealing engagement, the surfaces may each have a slight corresponding inward taper.

To insure the formation of an effective seal, or as a substitute to the above sealable mating surfaces, the sealing means of the invention may include a resilient sealing member. As shown, groove 49 is formed about the circumference of outer surface 47. O-ring 50 is placed in the groove so that a portion of the O-ring will compress and seal against wall surface 31". As the interior portion unseats from the head section to an open position, as shown by arrows A in FIG. 4, the O-ring will slide along the wall surface and decompress as it passes top edge 36.

Either alone or in combination with one or both of the above, the sealing means may further comprehend the sealing engagement of peripheral flange 45 with top edge 36. In such case, the flange underside and top edge should have flat mating surfaces. A gasket means therebetween, such as a rubber washer (not shown), may also be used to enhance sealability.

The actuator stem of the valve means comprises upwardly extending opposing segments 57,57 of the ring part wall structure. Each segment has a base portion 58,58 which comprises less than half the circumference of the wall structure. The circumference of each segment diminishes as each extends upwardly in a uniform and corresponding manner while maintaining the initial separation equal to the ring part diameter. When the segments approach their desired length, they curve inwardly and merge forming an actuation end 60.

The segments define an elongated open structure comprising opposing arcuate mirror-image sections with corresponding side edges 59. The structure readily passes liquid and can also be manually grasped to move the head section in and out of engagement with the interior portion. Also, since the segment spacing is maintained, the opposing segment outer wall surfaces will slide against the aperture sidewalls 31. This action will serve to guide and facilitate stable axial movement of the actuator stem.

When the head section is in a closed position, the actuation end will be at its outermost point a predetermined distance from the exterior aperture opening 62. Such distance should at least equal the axial distance required for unseating the head section from the interior portion.

Additional stem length adjustment may be required to insure that the actuator end will contact bottom wall 18 as the spout and valve assembly are lowered into the inner container 16. Unless the actuation end impinges the bottom wall before the bottle shoulder 19 engages cabinet ring 20, the interior portion will not be moved away from head section 42 and allow liquid flow.

Figure 6:
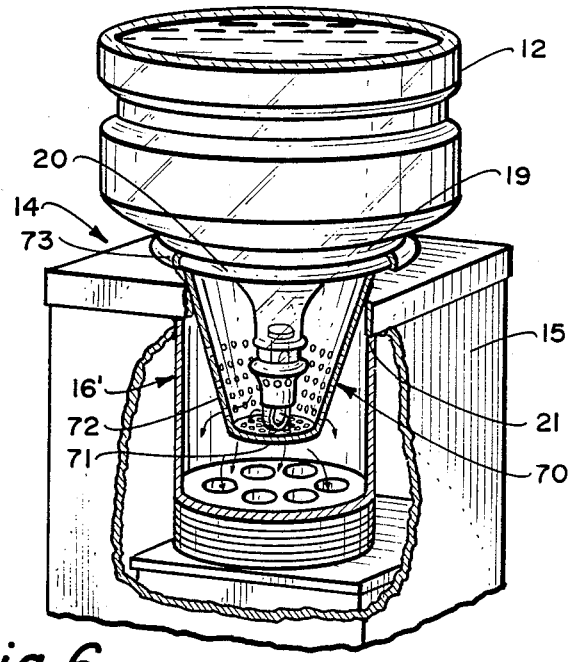
FIG. 6 is a view similar to FIG. 5 illustrating an adaptor means for use with dispenser containers having a depth greater than the maximum axial extent of the valve assembly actuator stem.

To avoid the above circumstance and provide for universal application of the invention with a diversity of liquid dispensing apparatus, an abutment basket 70 is provided. As illustrated in FIG. 6, the basket is utilized when inner container 16' has an extended sidewall and greater depth. The basket comprises a bottom contact wall 71 from which extends an openwork sidewall 72. The sidewall diverges upwardly and terminates with a dispenser engagement means. Such means comprises a peripheral rolled edge 73 which engages cabinet ring 20. The basket depth will correspond to the vertical distance required for contact with actuation end 60 and unseating of the head section 42. When a bottle spout with valve assembly is lowered into the basket suspended within the container, end 60 will contact bottom wall 71 and allow for valve opening in the same manner as before.

While the invention has been described with respect to preferred embodiments, it will be apparent to those skilled in the art that additional modifications may be made without departing from the scope and spirit of the invention. Accordingly, it is to be understood that the invention is not to be limited by the specific illustrative embodiments, but only by the scope of the appended claims.

I claim:

1. A liquid container with a spout and discharge outlet in combination with a valve assembly, said valve assembly comprising:

a valve housing enclosing said outlet having attachment means for releasable securement to said spout, said housing providing a central aperture in communication with said outlet, said aperture defined by a sleeve-shaped sidewall with an inner wall surface; and, a valve means controlling liquid flow through said aperture comprising a valve head section having a ring part for sealing engagement with said inner wall surface and an actuator stem comprising segments spaced-apart adjacent said inner wall surface and extending from said ring part a predetermined distance past said outlet whereby movement of said stem will provide a corresponding movement of said head section for seating and unseating said section from said aperture.

2. The combination of claim 1 wherein said sidewall includes an interior portion having a top edge and said head section includes an end plate having a peripheral flange that abuts said top edge when said section is in a closed position.

3. The combination of claim 1 wherein said ring part includes a resilient sealing member that engages said inner wall surface when said head section is in a closed position.

4. The combination of claim 1 wherein said sidewall includes an exterior portion extending beyond said discharge outlet an amount less than said predetermined distance.

5. The combination of claim 4 including at least one vent opening extending through said exterior portion.

6. The combination of claim 1 wherein said segments merge to form an outer actuation end.

7. The combination of claim 1 wherein the periphery of said discharge outlet comprises an annular bead and said attachment means comprises a curved skirt flange overlying a major portion of said bead.

8. The liquid container and valve assembly of claim 1 in combination with ,a liquid dispensing apparatus having a cabinet with an inner container, said combination further including an adaptor means suspended within said inner container for contacting said actuator stem and restraining vertical movement of said stem when said valve assembly is lowered into said inner container.

9. The combination of claim 8 wherein said adaptor means comprises an abutment basket having a bottom contact wall for contacting said actuator stem.

10. A valve assembly for regulating flow of liquid from a container through the discharge outlet of a spout in the container comprising:

a housing releasably secured to said spout having a central aperture in communication with said outlet, said aperture having an interior portion and an exterior portion; and, a plunger axially movable in said aperture having a head section with sealing means for engagement with said interior portion when said plunger is in a closed position, said plunger having an actuator stem comprising elongated segments spaced-apart adjacent said aperture and extending through and beyond said exterior portion a predetermined distance.

11. The assembly of claim 10 wherein said aperture is disposed lengthwise relative to said spout.

12. The assembly of claim 11 wherein said interior portion extends into said outlet.

13. The assembly of claim 11 wherein said interior portion terminates at a top edge and said head section comprises an end plate overlying said top edge.

14. The assembly of claim 13 wherein said end plate includes an inner face and said head section includes a ring part that extends from said face and merges into said actuator stem.

15. The assembly of claim 14 wherein said ring part includes an outer circumferential groove and said sealing means comprises a resilient sealing member positioned in said groove.

16. The assembly of claim 11 wherein said exterior portion includes at least one vent opening permitting air to flow from outside said housing into said aperture.

17. The assembly of claim 10 wherein said segments extend axially from said head section and form an elongated open structure.

18. The assembly of claim 10 wherein said sealing means comprises a resilient sealing member.

19. The assembly of claim 10 in combination with a liquid dispensing apparatus having a cabinet with an inner container, said combination further including an adaptor means suspended within said inner container for contacting said actuator stem and restraining vertical movement of said stem when said valve assembly is lowered into said inner container.

20. The assembly of claim 19 wherein said adaptor means comprises an abutment basket having a bottom contact wall for contacting said actuator stem.

* * * * *